United States Patent [19]

Rebeaud

[11] Patent Number: 4,690,567

[45] Date of Patent: Sep. 1, 1987

[54] ELECTRICAL CONNECTION ARRANGEMENT BETWEEN THE BRACELET AND THE CASE OF AN ELECTRONIC APPLIANCE TO BE WORN ON THE WRIST

[75] Inventor: Jean-Philippe Rebeaud, Cressier, Switzerland

[73] Assignee: ETS SA Fabriques d'Ebauches, Granges, Switzerland

[21] Appl. No.: 802,915

[22] Filed: Nov. 29, 1985

[30] Foreign Application Priority Data

Dec. 10, 1984 [CH] Switzerland ..... 05847/84

[51] Int. Cl.[4] ..... G04B 1/00; G04B 37/00

[52] U.S. Cl. ..... 368/203; 368/282

[58] Field of Search ..... 368/280–282, 368/203, 204

[56] References Cited

U.S. PATENT DOCUMENTS

| | | | |
|---|---|---|---|
| 2,665,542 | 1/1954 | Sheldon | 368/204 |
| 3,783,604 | 1/1974 | Florent et al. | 368/204 |
| 3,973,706 | 8/1976 | Boyce et al. | 368/204 |
| 3,975,899 | 8/1976 | Haber | 368/280 |
| 3,977,176 | 8/1976 | Murakani et al. | 368/282 |
| 4,194,355 | 3/1980 | Nishida | 368/282 |
| 4,323,996 | 4/1982 | Ganter | 368/204 |

FOREIGN PATENT DOCUMENTS

| | | | |
|---|---|---|---|
| 1094667 | 8/1960 | Fed. Rep. of Germany | 368/204 |
| 1075505 | 11/1960 | Fed. Rep. of Germany | 368/204 |
| 377736 | 6/1964 | Switzerland | 368/204 |
| 880121 | 10/1961 | United Kingdom | 368/204 |

*Primary Examiner*—Bernard Roskoski

*Attorney, Agent, or Firm*—Sughrue, Mion, Zinn, Macpeak, and Seas

[57] ABSTRACT

The connection arrangement of this invention includes one or several sets of electrical contacts, respectively within the case of an electronic appliance and the bracelet thereof. These contacts are separable by virtue of being associated with elastic latching means. Moreover they are surrounded by a complementary abutment surfaces which protect them from all damaging influence coming from the exterior (in particular that resulting from corrosive substances which may be exuded by the wrist). These surfaces are firmly applied to one another by the latching force of the contacts.

The invention may be applied in particular to any timepiece having a bracelet.

9 Claims, 9 Drawing Figures

ELECTRICAL CONNECTION ARRANGEMENT BETWEEN THE BRACELET AND THE CASE OF AN ELECTRONIC APPLIANCE TO BE WORN ON THE WRIST

This invention concerns electronic appliance intended to be worn on the wrist of a user. More precisely, the invention concerns a connection arrangement between portions of a circuit located respectively in the case and the bracelet of an electronic appliance intended to be worn on the wrist, in which in each electrical path between said portions there is inserted a set of separable mating contacts which are however maintained applied to one another by an elastic latching effect, each set of contacts exhibiting at least partially a rotation symmetry defining an axis.

BACKGROUND OF THE INVENTION

Such an arrangement has been described in U.S. Pat. No. 3,973,706. Here the connection arrangement exhibits the form of a set comprising a plug and a socket, the elements of which are lodged on the inside of the case, the plug being latched into a hole in the case. In addition to which this plug is integral with a flexible band of insulating material in which are embedded the wires coupling it to the portion of the circuit (a battery for instance) lodged in the bracelet. Such band passes around the joint between the bracelet and the case.

This prior arrangement exhibits in essence two difficulties. One resides in the fragility of the connection band which is stressed each time the electronic appliance is fastened to or removed from the wrist. Such band is likely thus to be worn out or broken quite rapidly. The other difficulty resides in the poor sealing which is obtained between the plug and the hole of the case in which it is engaged, such sealing moreover being destroyed if for one reason or another the bracelet is disconnected from the case.

Another connection arrangement of this type has been described in U.S. Pat. No. 3,975,899. It comprises an elastic blade projecting from the case and elastically connected to the circuit lodged in the latter. This blade is supported against the axis of articulation coupling the bracelet to the case in a manner such that this axis itself participates in the transmission of electrical energy to the case. The electrical connection is thus exposed to the open air and may rapidly deteriorate by oxidation, by dust and other factors. This solution is thus far from being satisfactory.

The purpose of the invention is to furnish a connection arrangement of the type indicated above which not only assures in a durable manner a good electrical contact between the bracelet and the case of the appliance, but moreover maintains perfectly the sealing of the case which is not destroyed even when for one reason or another the bracelet must be changed.

SUMMARY OF THE INVENTION

The invention thus has as objective an arrangement of electrical connections of the type defined hereinabove which is characterized in that their contacts are applied to one another by a latching force directed along the axis and in that they are surrounded by two complementary butting surfaces provided respectively on the case and on the bracelet and applied to one another by the presence of the latching force in order to protect the contacts from harmful influences coming from the exterior.

It is thus possible to assure at all times perfect sealing of the case and total sealing off of the electrical contacts with respect to the exterior. This latter property of the connection arrangement in accordance with the invention thus protects the contacts from all harmful influence likely to cause corrosion arising for example from the proximity of the skin of the user. The long life of these contacts is thus assured. To this may be added that the bracelet may readily be replaced since the connection arrangement remains separable.

DESCRIPTION OF THE PREFERRED EMBODIMENT

Figure 1:
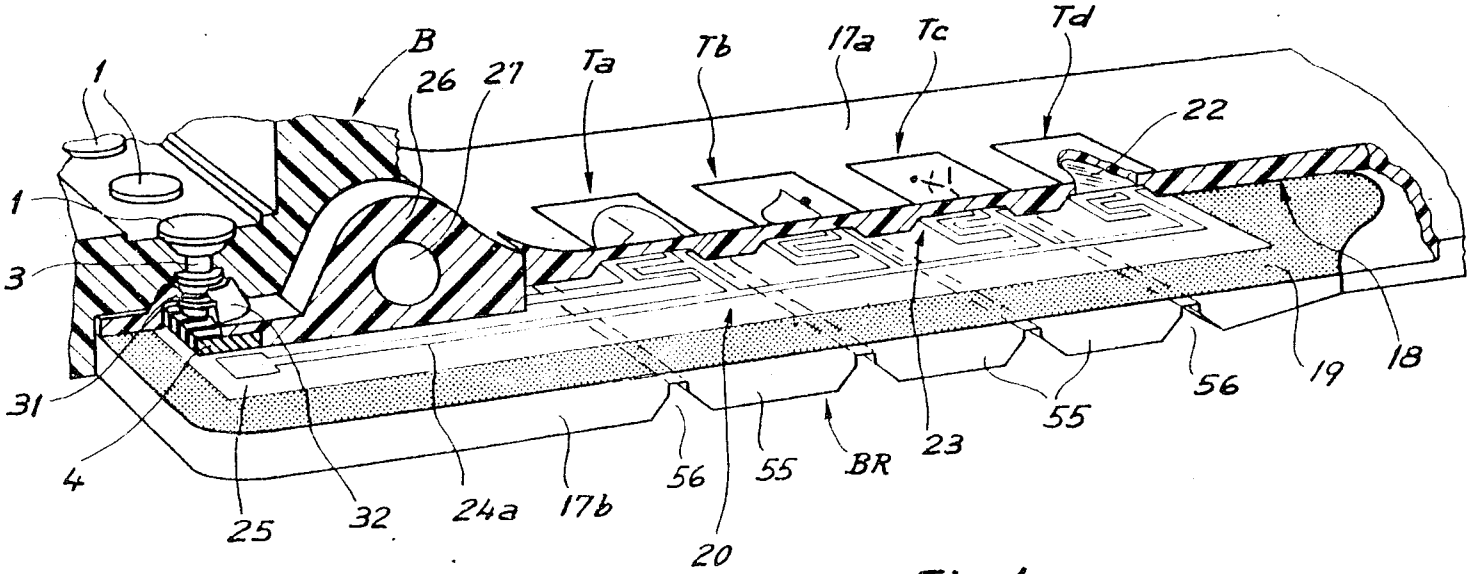
FIG. 1 is a perspective view of an electrical connection arrangement in accordance with the invention in conformity with the preferred embodiment thereof.
Figure 2:
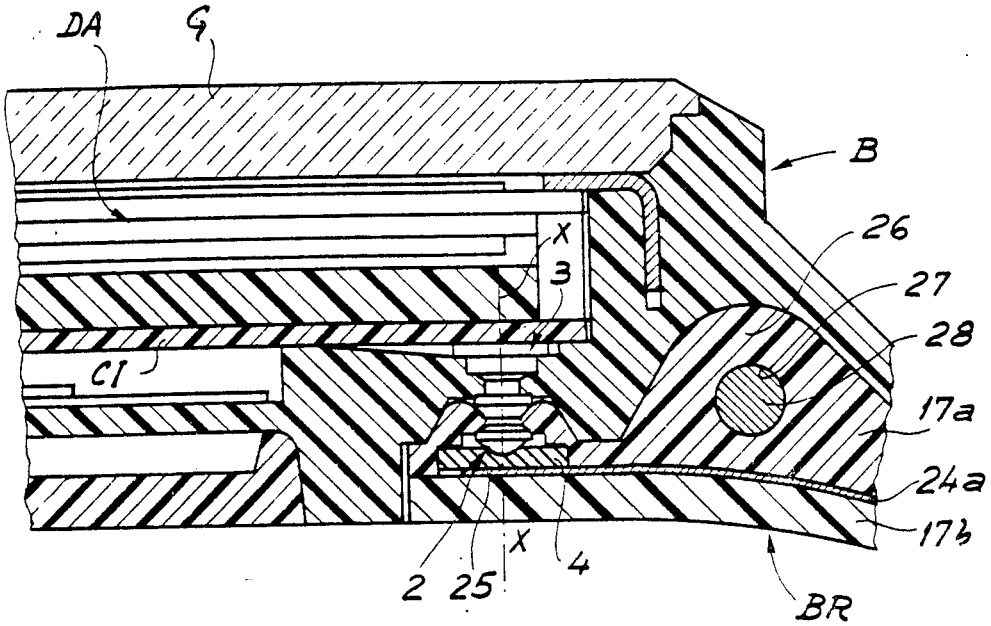
FIG. 2 is an axial cross-section of a connection arrangement in accordance with the invention corresponding to that of FIG. 1.
Figure 2A:
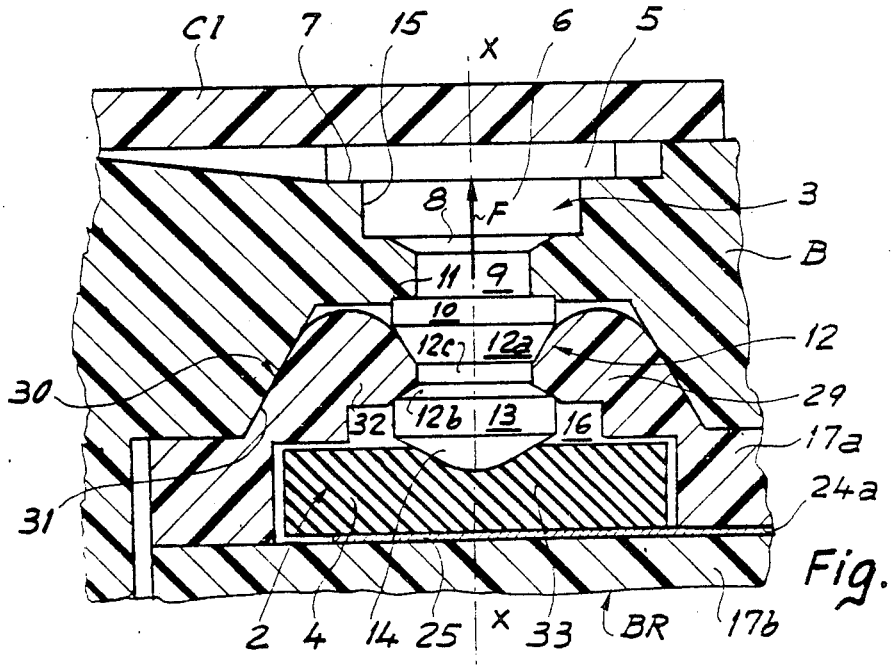
FIG. 2A shows an enlarged cross-section of the connection arrangement.

Without intending to limit in any manner the invention as described the example as now set forth making reference to FIGS. 1, 2 and 2A concerns a case B associated with a bracelet BR between which there are to be established several electrical paths at the point of separation between these two elements, by connection arrangements in accordance with the invention, these arrangements being designated together by reference 1. Case B encloses the electrical or electromechanical circuit of a timepiece but it should be emphasized that the invention may be applied in all cases where an electrical appliance is associated with a bracelet which bears one or several components which are to be associated with a circuit located in case B.

On FIG. 2 it will be seen that the case contains a printed electrical circuit CI provided with an integrated circuit (not shown) and a display arrangement DA, the case being closed by a crystal G.

The connection arrangement comprises sets of contacts 2 composed of a rigid conductive element 3 and an elastic conductor 4. The first of these contacts is here a conductive foot of a generally cylindrical form having an axis X—X.

This foot exhibits an exterior surface including several portions which comprise, as seen from top to bottom on FIG. 2A, a support 5 separated from a support 6 by a radial shoulder 7, a tapered portion 8 followed by a cylindrical portion 9, a support 10 separated from the cylindrical portion 9 by a shoulder 11, a portion 12 exhibiting in particular two inclined surfaces 12*a* and 12*b* between which is provided a cylindrical surface 12*c*, a cylindrical portion 13 and finally a tip 14 of generally conical form.

This relatively complex form of the external surface of the foot is intended in the zone where such foot is fixed in the case B, to assure a total sealing off of the internal cavity of such case from the exterior. As may be well understood, the case includes a cavity 15 with surface portions complementary to those of the corresponding portion of the foot a detailed description of which is superfluous. It is sufficient to note that the definitive form of cavity 15 of the case through which the foot 3 extends, is obtained in the course of setting into place such foot which preferably is effected by the application of ultrasonic vibrations. Additionally, one may complete the sealing by pouring around the top of the foot 3 a small quantity of a polymerizable material after the setting into place, such material being drawn in by capillarity around the support 5 in order to close all interstitial gaps remaining around the body after insertion into case B.

Portions 12*a*, 12*b* and 12*c* are intended to assure the rigidity of the connection arrangement by elastic latching. To this effect the end of the bracelet BR is formed in a manner so as to define a cavity 16 into which the lower portion of the foot 3 may penetrate.

Figure 3:
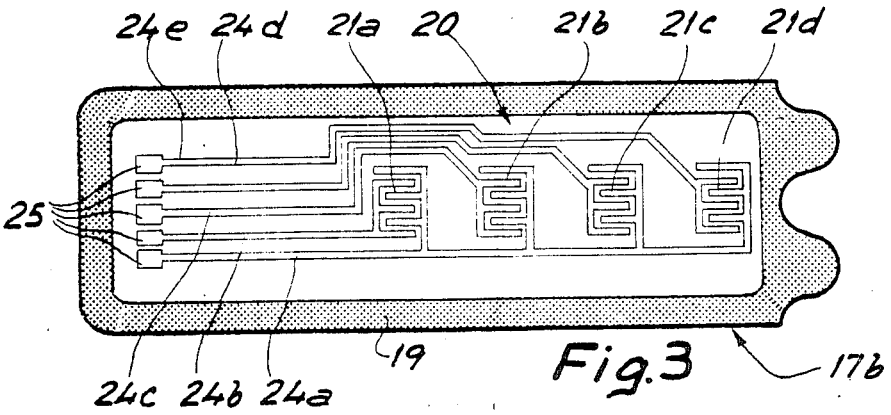
FIG. 3 is a plan view of one of the tongues of the bracelet showing in particular the conductive tracks intended to be coupled to the connection arrangements shown on FIGS. 1 and 2.

Before examining in greater detail this portion of the connection arrangement, it may be useful to refer to FIGS. 1 and 3 which show the construction of the bracelet.

In the example described here, the part of the coupling arrangement lodged in the bracelet comprises four function keys designated generally by references Ta to Td capable of setting off in the circuit CI the functions "Time", "Alarm", "Chronograph" and "Countdown".

The half-bracelet shown comprises two strips 17*a* and 17*b* of a flexible plastic material, strip 17*b* fitting into a recess 18 provided in the end portion of strip 17*a* proximate case B. This recess has a thickness which is approximately equal to the half of the total thickness of strip 17*a*. The latter is solidly coupled with strip 17*b*, by gluing for instance, an adhesive being provided to this effect (at 19) over the entire periphery of strip 17*b*.

Such strip 17*b* is likewise provided with a set of conductors 20 which may be fixed thereto by silkscreening for instance. Such set of conductors is provided on the surface of strip 17*b* turned towards strip 17*a*.

FIG. 3 shows that the set of conductors defines four fixed contacts, each taking the form of two combs 21*a* to 21*d* respectively associated with movable contacts formed by metallization 2 (only the metallization of key Td is clearly shown on FIG. 1). This set of a fixed and movable contact forms a switch which is closed when through pressure of a finger, the zone corresponding to a given key is deformed and the metallization 22 brought to bear on the embedded combs corresponding thereto. To increase the flexibility of strip 17*a* in the zones where the keys Ta to Td are located, there is provided proximate each of these keys a cavity 23 opening towards strip 17*d* and on the bottom of which is the metallization 22.

On FIG. 3 is likewise clearly seen that the pairs of combs 21*a* to 21*d* are coupled to conductors 24*a* to 24*e* it being well understood that conductor 24*a* is common to all the pairs of combs 21*a* to 21*d*. Each of conductors 24*a* to 24*e* is extended towards the end of strip 17*b* to end in a terminal 25.

It will thus be understood that when a zone of strip 17*a* corresponding to one of keys Ta to Td is pressed in, the metallization 22 couples the two combs corresponding to this key to one another which establishes a short-circuit between conductor 24*a* on the one hand and one of conductors 24*b* to 24*e* on the other hand, the two corresponding terminals 25 being then coupled to one another.

Strip 17*a* includes moreover a thickened zone 26 of convex form, in which there is provided a transversal opening 27 intended to receive an axis 28 by means of which the bracelet is articulated to case B, this latter comprising to this effect a form adapted to the hump 26 (see in particular FIG. 2). It is to be noted that the articulation between case B and bracelet BR is only partially shown, its form moreover being standard.

In the zone of strip 17*a* situated beyond hump 26, i.e. the end of such strip, are provided elements which assure the latching of the connection arrangement and in order to examine these elements, reference will again be had to FIG. 2.

Since in the embodiment shown five terminals 25 are provided to be connected to the circuit CI in case B, it is evident that five sets of contacts must be provided.

Each of these arrangements thus includes centered on axis X—X an annular rib 29 having a tapered exterior surface 30 to which corresponds a complementary tapered surface 31 provided in case B and which constitutes thus a portion of the wall of the cavity 15 of the latter. It will be seen hereinafter that these two surfaces have great importance for obtaining the protection of the contacts of each of the connection arrangements.

The annular rib 29 thus bounds the cavity 16 described hereinabove, the opening of which is formed by a collar 32. The radial section of the latter takes a V form of which the point is directed towards axis X—X. Preferably one of the branches of this V, i.e. that which is closest to the free end of foot 3, is inclined relative to the radial plane passing through the point of the V by 30°, the other branch being 60°. To these angles moreover corresponds the slope of surfaces 12*a* and 12*b* of foot 3.

From this it will be understood that considering the fact that the portion 13 of foot 3 exhibits a diameter clearly greater than the smallest diameter of collar 32, the insertion of the foot into the cavity 16 provides initially a deformation of the rib 29 during the passage of portion 13, then an elastic latching when collar 32 penetrates into the groove bounded by the portions 12*a* to 12*c* of the foot 3. The dimensions of these parts have been chosen in a manner such that surfaces 30 and 31 are tightly applied to one another with the rib 29 being drawn axially upwards (force F shown on FIG. 2A). To this may be added that the tapered surfaces 30 and 31 are narrowed in a sense corresponding to that of the latching force. On the other hand, since the contact sets are provided in a zone of the bracelet which is situated at an extremity extending beyond the articulation of the bracelet relative to its principal portion, such force is in a certain manner increased by the force which results from the torque created about the axis 27 by the natural curvature of the bracelet when the electronic appliance is worn on the wrist. There results therefrom thus that the cavity 16 in which the electrical contact is to be established is perfectly sealed from the outside.

FIGS. 1 and 2 show clearly that terminals 25 are in contact with a connection block 33 which constitutes an elastomeric connector composed of zones alternatively conducting and insulating and provided in a flexible material such as a silicone, the conductive zones being loaded with carbon particles. It will be understood thus that these conductive zones may establish an electrical connection between terminals 25 and the ends of feet 3, the latter deforming slightly the contact block 33 in the regions where they are applied. It is to be noted that the elasticity of block 33 contributes to a good contact pressure thanks to the deformation which this block undergoes at the time of the assembly of the connection arrangements.

It is to be noted that the abutment surfaces 30 and 31 have a tapered form coaxial to axis X—X, their taper being turned in a manner such that they are applied to one another with a force which increases as the retaining force of the foot in the cavity 16 is greater.

Hereinafter there will be described several other possible methods of realizing the invention through reference more particularly to FIGS. 4 to 8. In these figures identical or equivalent elements of the connection arrangement corresponding to the preceding example have the same reference numbers.

Figure 4:
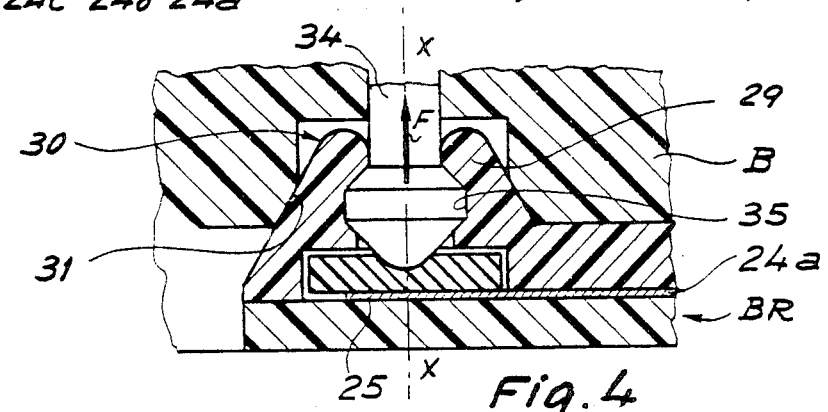
FIGS. 4 to 7 show axial cross-sections of four other embodiments of the invention.

On FIG. 4, the connection arrangement comprises conductive feet 34, the ends of which instead of presenting a concave profile, have a greater diameter than the remainder of the foot in order to assure latching in an interior annular groove 35 with which the rib 29 is provided. One may readily see that this arrangement has the same effects as those resulting from the connection arrangements previously described, the surfaces 30 and 31 being applied to one another in the same manner.

Figure 5:
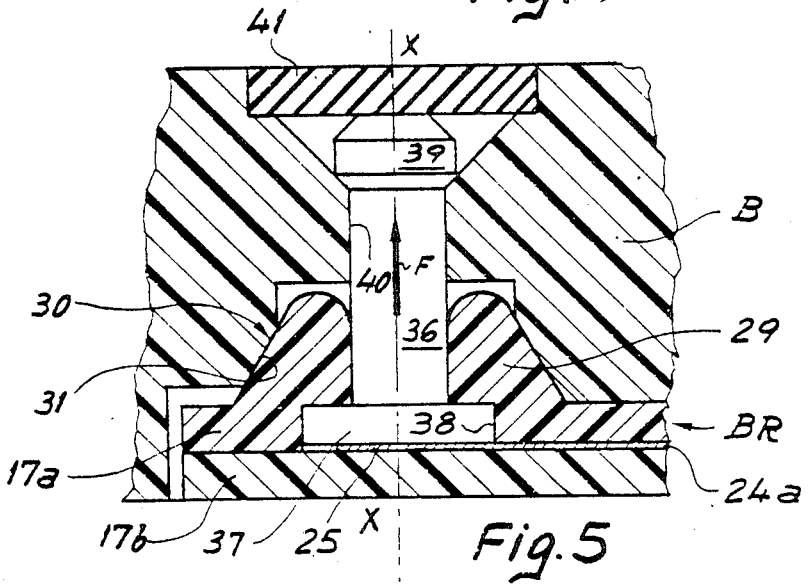

In the case of FIG. 5 this concerns an inverted arrangement in the sense that there is provided a foot 36 of conductive material which is anchored by a flange 37 in a cavity 38 provided in the rib 29 of the strip 17*a*. This foot is fixed moreover by strip 17*b* which as previously described is glued to strip 17*a*. The upper portion of the foot 36 exhbits a boss 39 of circular section having a profile almost identical to that of the end of the foot 34 in FIG. 4, such boss being inserted in an opening 40 provided in the case, the elastic latching being obtained by the fact that boss 39 exhibits a diameter greater than that of the opening 40. Likewise in this case, surfaces 30 and 31 provided respectively on rib 29 of the bracelet BR and on the case B are applied to one another by the force generated by the elastic latching. In the case of FIG. 5, the boss 39 is applied against a contact block 41 which is lodged in the case rather than being so lodged in the bracelet.

Figure 6:
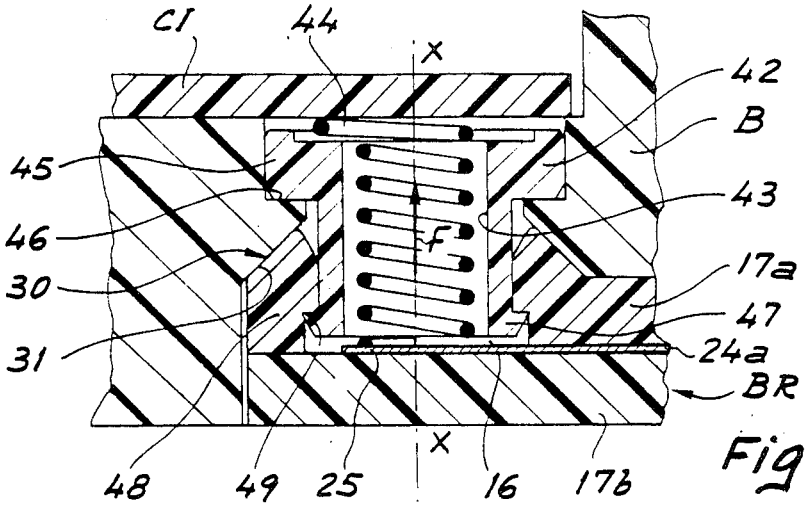

In the embodiment of FIG. 6, the connection arrangement comprises a foot 42 exhibiting a central cavity 43 in which is lodged a conductive spring 44. This latter has its ends applied on the one hand to a track (not visible on the drawings) of the printed circuit CI and on the other hand to the corresponding terminal 25 of the bracelet.

The foot 42 itself comprises an external rim 45 which is supported on a shoulder 46 of the case while its opposite end is provided with a locking ring 47 of wedge form.

For its part, the strip 17*a* exhibits a rib 48 which bounds a shoulder 49 behind which may be coupled by elastic latching the ring 47 of foot 42. Furthermore, as in the preceding forms, rib 48 comprises a tapered external surface 30 which cooperates with a complementary surface 31 provided on case B. Here also the surfaces are applied to one another thanks to the elastic force which arises when ring 47 is coupled behind shoulder 49. Thus the cavity 16 which here is formed not only by the space bounded between strip 17*b* and foot 42 but also by the central cavity 43 of the latter, is perfectly sealed off from the exterior avoiding thus all deterioration of the electrical circuit established by spring 44 between the printed circuit CI and the terminal 25. Preferably printed circuit CI seals this same cavity 16 so as to furthermore seal it off from the interior cavity of case B. In this manner the sealing of the latter remains intact even when the bracelet is removed from the case and one proceeds to disconnect the coupling arrangements.

Figure 7:
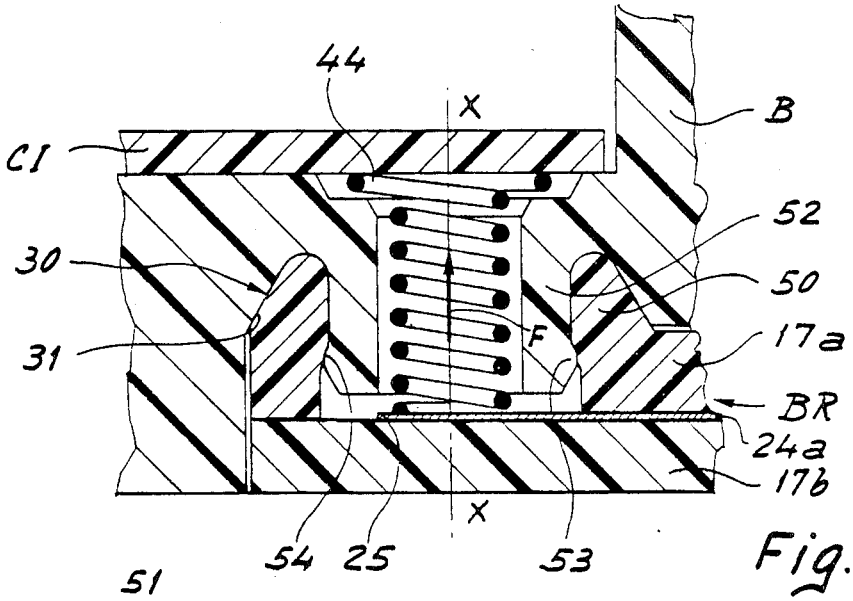
Figure 8:
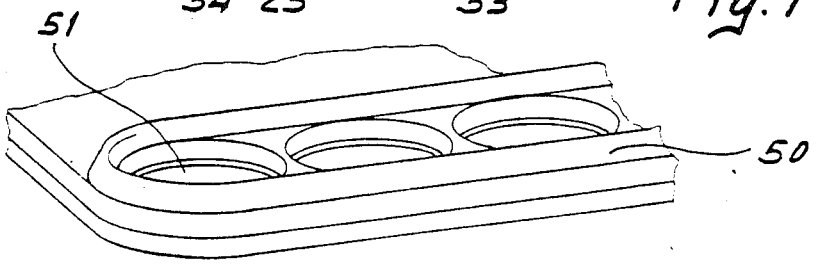
FIG. 8 is a partial perspective view of a variant of the connection arrangement in accordance with the invention.

The embodiment shown on FIGS. 7 and 8 is different from the preceding arrangement through the fact that the sealing surfaces 30 and 31 are not individually provided for each connection arrangement but rather are common to all of the latter. To this effect there is provided a rib 50 which surrounds a row of holes 51 aligned along the edge of the end of strip 17*a* of the bracelet BR and which individually receives insulating feet 52, the latter being of a material common with the case B and at the same time being provided with a sealing surface 31 likewise surrounding all the feet 52. The elastic latching however is individually present for each foot since such include at their free ends a bulge 53 cooperating with a groove 54 provided on rib 50.

It will be understood that the arrangements of FIGS. 4 to 6 may be inverted, i.e. with the hollow foot on the bracelet and the rib on the case.

Finally, as concerns the bracelet and as visible on FIG. 1, strip 17*b* exhibits reinforcement zones 55 separated by transversal grooves 56 and intended to reinforce the bracelet opposite keys Ta to Td, so as to avoid the risk of unforeseen contact due to the curvature of the bracelet.

What I claim is:

1. An electrical connection arrangement between portions of a circuit located respectively in the case and the bracelet of an electronic appliance to be worn on the wrist, said connection arrangement comprising:

at least one electrical path means inserted between portions of a circuit located respectively in a case and a bracelet of an electronic appliance to be worn on the wrist, said path means comprising a set of mating contacts which are separable but maintained applied to one another by a latching effect, said set of contacts exhibiting at least partially a rotation symmetry defining an axis;

means associated with said set of mating contacts for generating an elastic force directed along said axis of said set of mating contacts so as to achieve said latching effect; and complementary abutment surfaces provided respectively on the bracelet and the case, said complementary abutment surfaces surrounding said mating contacts and being applied against one another also by said latching effect in such a manner as to seal said mating contacts off from the exterior.

2. An electrical connection arrangement as set forth in claim 1 wherein said abutment surfaces are tapered and are narrowed in the sense corresponding to that along which the force acts.

3. An electrical connection arrangement as set forth in claim 1 wherein the set of electrical contacts is placed in a region of the bracelet located, relative to the main strand thereof, beyond the axis around which such strand may pivot on the case and wherein said axis of symmetry is perpendicular to the pivoting axis.

4. An electrical connection arrangement as set forth in claim 1 wherein one of the contacts of said set comprises a conductive foot mounted in a sealed manner in said case whilst projecting beyond the outer surface thereof and wherein said foot coacts with an annular rib provided on the bracelet into which it penetrates to be latched by virtue of complementary annular surfaces provided on the foot and the rib.

5. An electrical connection arrangement as set forth in claim 4 wherein the other contact of the set comprises an elastic block formed of electrically conductive plastic material which is partially deformed by said foot when the connection arrangement is assembled and which is electrically coupled to the portion of the circuit located in the bracelet.

6. An electrical connection arrangement as set forth in claim 1 wherein one of the contacts of the set comprises a conductive foot anchored in the bracelet and penetrating an opening in the case, said opening and said foot exhibiting complementary annular surfaces to assure latching together thereof.

7. An electrical connection arrangement as set forth in claim 1 wherein said set of electrical contacts includes a conductive spring interposed between the two portions of said circuit and mounted in a hollow foot fixed to the case, said foot being profiled so as to be latched into an annular rib provided on the bracelet.

8. An electrical connection arrangement as set forth in claim 7 wherein said hollow foot is materially integral with the case.

9. An electrical connection arrangement as set forth in claim 1 wherein several contact sets are provided arranged in a row and wherein said abutment surfaces are common to all of such contact sets.

* * * * *